US007013791B2

(12) United States Patent
Galba

(10) Patent No.: US 7,013,791 B2
(45) Date of Patent: Mar. 21, 2006

(54) AXIAL PISTON MACHINE WITH A SWASH PLATE

(75) Inventor: Vladimir Galba, Puskinova (SK)

(73) Assignee: Poclain Hydraulics, Verberie (FR)

( * ) Notice: Subject to any disclaimer, the term of this patent is extended or adjusted under 35 U.S.C. 154(b) by 0 days.

(21) Appl. No.: 11/060,234

(22) Filed: Feb. 17, 2005

(65) Prior Publication Data

US 2005/0186085 A1 Aug. 25, 2005

(30) Foreign Application Priority Data

Feb. 17, 2004 (WO) ..... PCT/EP04/01560

(51) Int. Cl.
*F04B 1/22* (2006.01)

(52) U.S. Cl. ..... 91/499

(58) Field of Classification Search ..... 91/499; 417/269

See application file for complete search history.

(56) References Cited

U.S. PATENT DOCUMENTS 3,407,744 A * 10/1968 Slimm ..... 91/499
3,589,756 A 6/1971 Pruvot
3,911,791 A * 10/1975 Clerk ..... 91/499
4,304,173 A 12/1981 Brille
4,382,399 A * 5/1983 Lotter ..... 91/499
4,478,134 A * 10/1984 Kawahara et al. ..... 91/499
5,537,743 A 7/1996 Hibino et al.
6,358,018 B1 * 3/2002 Alm ..... 417/269
6,669,450 B1 * 12/2003 Jeong ..... 417/269

FOREIGN PATENT DOCUMENTS

GB 1140167 1/1969

* cited by examiner

*Primary Examiner*—Michael Koczo, Jr.
(74) *Attorney, Agent, or Firm*—Ladas & Parry LLP

(57) ABSTRACT

The axial piston machine comprises a case, a shaft and a cylinder block (2), arranged so as to rotate in the case and having a plurality of cylinders (21) with pistons, adapted to slide in said cylinders and connected to piston rods (6) by means of first spherical joints, the piston rods being connected to a sliding plate (7) by means of second spherical joints (63), said sliding plate (7) being supported by a swash plate (8) via a bearing (72). For the connection between a piston rod (6) and the sliding plate (7), the machine further comprises a first driving rotational surface (61) linked to the piston rod (6) and a corresponding second driving rotational surface (71) linked to the sliding plate (7), a clearance being left between said first driving rotational surface (61) and said second driving rotational surface (71) and said surfaces being adjacent.

20 Claims, 7 Drawing Sheets

FIG.5
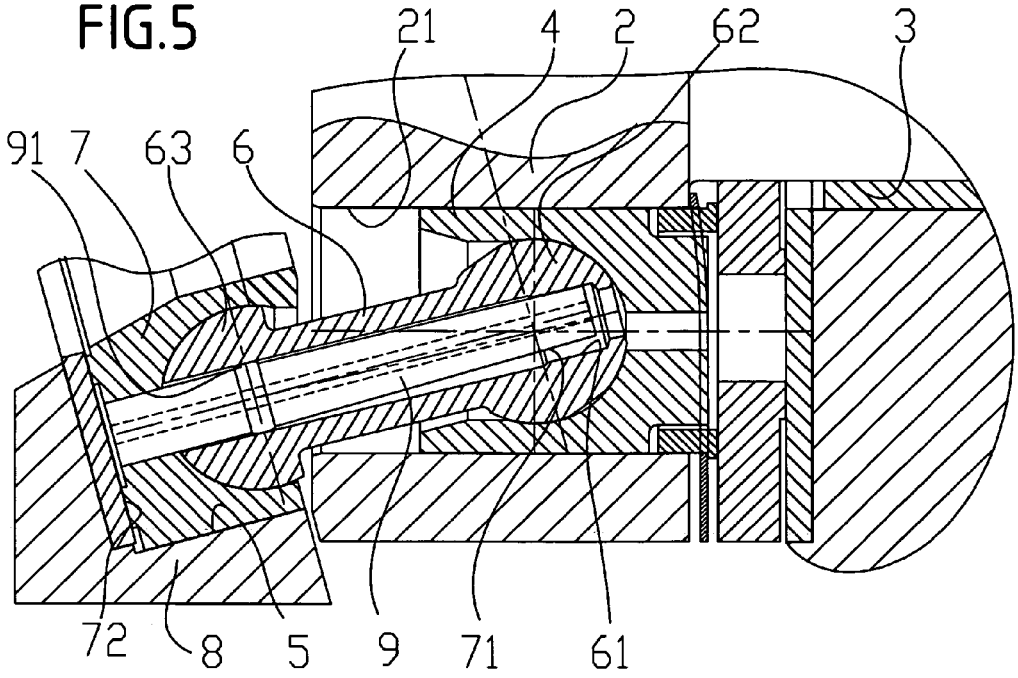
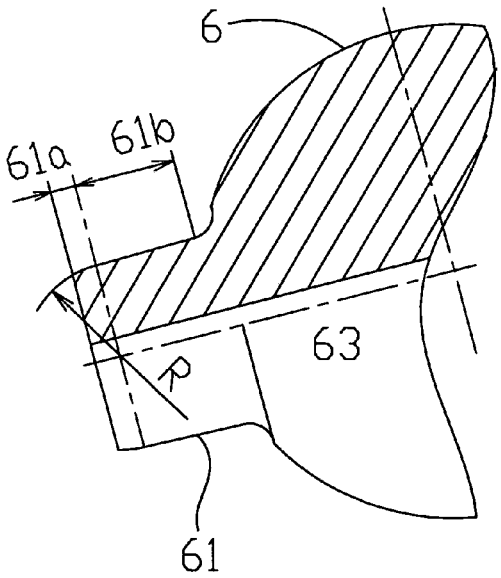
FIG.7A
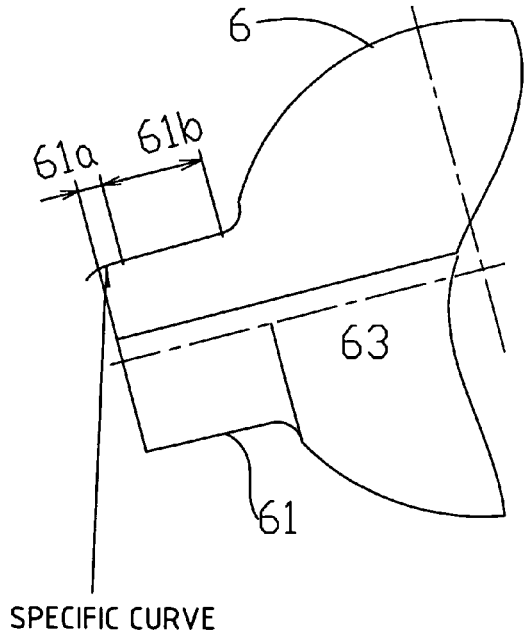
FIG.7B

AXIAL PISTON MACHINE WITH A SWASH PLATE

BACKGROUND OF THE DISCLOSURE

This invention generally relates to swash plate type axial piston machines and in particular to any machine with a rotating cylinder block comprising pistons, axial forces of which are transmitted on a swash plate by piston rods connected to a common sliding plate by spherical joints.

DE 40 24 319 discloses a hydraulic machine having a cylinder block with axial pistons and a swash plate supporting a sliding plate. The pistons are connected to piston rods by means of first spherical joints, the piston rods being connected to the sliding plate by means of second spherical joints. The angular position of the cylinder block with respect to the sliding plate is synchronized by a couple of bevel gears, respectively fixedly connected with the cylinder block and with the sliding plate. This bevel gearing can also transmit a portion of the torque developed by this piston machine. The disadvantage of this solution is that it is only usable for axial piston machines with a constant displacement volume because the bevels gears engage for a given inclination of the swash plate. Therefore, the inclination of the swash plate cannot be changed and this solution is not applicable for axial piston machines with a variable displacement volume (cylinder capacity).

Another solution for swash plate type axial piston machines is known by GB1,140,167 and is supposed to be usable with a variable displacement. With this solution, a synchronizing mechanism keeps the piston rods during their activity in a position, which is substantially perpendicular to a bearing surface of the sliding plate that is supported by the swash plate. This synchronization is obtained by slots made in a timing member fixed on the sliding plate and receiving the cylindrical piston rods. For each piston rod, the slot allows an unrestricted radial pivoting of the piston rod. During rotation of the cylinder block, a piston rod periodically abuts against one of the two parallel flat faces of the corresponding slot, so that this rod is maintained substantially perpendicular to the bearing surface of the sliding plate due to this contact between the cylindrical surface of the piston rod and the flat face of the slot. The contacting surfaces (that is the cylindrical surface of the piston rod and the flat face of the slot) have different profiles, so that the synchronization between the cylinder block and the sliding plate is significantly delayed. Furthermore, the manufacturing of the involved parts generates significant clearance increasing again the delay in synchronization. Therefore such a design delays the synchronization, generates higher loads in the piston rod and very high Hertzian contact pressures that may bring rapid pitting of the contacting surfaces.

SUMMARY OF THE INVENTION

The present invention seeks to improve the above cited prior art while providing a better synchronization, compatible with a machine having a variable displacement volume.

This object is achieved in the axial piston machine of the invention comprising a case, a shaft and a cylinder block arranged so as to rotate in the case, the cylinder block having a plurality of cylinders with pistons, adapted to slide in said cylinders and connected to piston rods by means of first spherical joints, the piston rods being connected to a sliding plate by means of second spherical joints, said sliding plate being supported by a swash plate via a bearing.

Substance of this invention is that, for the connection between a piston rod and the sliding plate, the machine further comprises a first driving rotational surface which is fixedly connected to the piston rod and a corresponding second driving rotational surface which is fixedly connected to the sliding plate, said first and second driving rotational surfaces being distinct from the second spherical joint that connects said piston rod to the sliding plate and each one of said driving rotational surfaces being formed by a rotation of a generating line around an axis, a clearance being left between said first and second driving rotational surfaces and said surfaces being adjacent.

In the meaning of the invention, a "rotational surface" is a surface that, in transverse section, has substantially the shape of a circle or of a portion of a circle; more specifically, such a "rotational surface" is formed by the rotation of a generating line around an axis. Preferentially, at least one of the first and second driving rotational surfaces is formed by at least a portion of a cylindrical surface. Such a rotational surface can be a closed cylindrical surface in which case it has a closed profile, or, depending on the application, it can be formed by at least one sector of a cylindrical surface and it can have an open profile defined in order to permit an efficient synchronization. Being formed by a rotation of a generating line around an axis, each one of said driving rotational surface is devoid of flat parts.

The indication that the first and second driving rotational surfaces are fixedly connected to, respectively, the piston rod and the sliding plate means that these surfaces can be formed in one piece with, respectively, the piston rod and the sliding plate, or be formed on distinct parts secured (e.g. by wedging, by fixing screws . . . ) thereto. In other words, the first and second rotational surfaces are respectively a surface of the piston rod and a surface of the sliding plate or of a part immovably connected to, respectively, the piston rod and the sliding plate.

The first driving rotational surface can be on an outer surface of the piston rod either on a projecting segment at the end of the second spherical joint or on a segment between the centers of the first spherical joint and the second spherical joint. Then the second driving rotational surface is on an inner surface such as a recess of the sliding plate or of a part immovably connected with the sliding plate.

The first driving rotational surface can be also on an inner surface of the piston rod. Then the second driving rotational surface is on a projecting segment such as a pin, which is introduced in a recess of the piston rod, the wall of which defines this first rotational surface and which is immovable towards the sliding plate.

With these complementary adjacent first and second driving rotational surfaces the synchronization in rotational movement of the sliding plate with the cylinder block is better achieved as the angular distance between the first and second driving rotational surfaces of each pair of driving rotational surfaces is significantly reduced, which provides a more continuous and smoother meshing and prevents shocks and irregularity of rotational movement of the piston rods when the driving contact is transferred from one piston rod to another one.

For example, with cylindrical first and second driving rotational surfaces, during a revolution of the cylinder block, the envelop of each first driving rotational surface describes, with respect to the sliding plate, a cone which is periodically in contact with the cylinder defined by the second driving rotational surface. In a plane perpendicular to the axis of rotation of the sliding plate, this cone has a section defining a pseudo-ellipse and this cylinder has a section defining a circle which remains closely adjacent to said pseudo-ellipse. The gap between the pseudo-ellipse and the circle is symmetrically distributed. Consequently it can be half of the difference between the major axis and the minor axis of the ellipse and can be kept very small compared to GB1,140,167. With different shapes of generating lines of driving rotational surfaces the envelops remain very close to the cone and cylinder.

This pseudo-ellipse allows defining the minimum functional clearance between the first and second rotational surfaces, and then the maximum functional clearance is determined specifically with respect to the dimensions and tolerances of the parts involved.

Piston rod pitch diameters (diameters of the circles described by the centers of the first and second spherical joints during the rotation of the cylinder block) are chosen so that the required gap is minimized (see formula thereafter). Then the delay of synchronization between the cylinder block and the sliding plate is also significantly reduced. Consequently, loads in the piston rod decrease and values of Hertzian contact pressures are significantly reduced.

When being machined the second driving rotational surface and the second spherical joint can be made more easily coaxial than in GB1,140,167 so that the clearance can be smaller. Consequently the rotational angular distance, that is the delay, between the cylinder block and sliding plate can be drastically reduced.

As indicated above, advantageously, at least one of the first and second driving rotational surfaces is formed by at least a portion of at least one cylindrical surface. Possibly, the first and second driving rotational surfaces for all piston rods can have such a shape.

Generally speaking, the rotational surface of the invention can be obtained by rotating a generating line around an axis. The profile of the generating line can be a straight line parallel or inclined with respect to the axis of rotation. The generating line can also be a curve. In order to decrease an edge influence of contact forces on driving rotational surfaces, at least one of the first and second driving rotational surface associated to a piston rod can have such a generating line that comprises a straight segment, which is continuously ended by a specific curve such as an arc, a logarithmic curve or any appropriated curve at least at one of its ends (this curve has thus a constant or a variable radius of curvature), the generating line can be formed of such straight segment and specific curve; as an other solution, the generating line can be any appropriated curve, having a constant radius of curvature (continuous convex curve) or a variable radius of curvature (variable convex curve). The contact pressure between the first and second driving rotational surfaces can also be reduced by adding a recess in a part, an outer surface of which forms the first or the second driving rotational surface, as for example inside the piston rod if a portion thereof has an outer surface that forms the first driving rotational surface.

The sliding plate must be centered with the pump shaft axis when the swash plate angle is equal to zero. To achieve that, the sliding plate is either radially embedded in the swash plate by a radial sliding bearing or is radially guided on its axis of rotation by a centering pivot, which is immovably connected with the sliding plate and is ended by centering spherical joint (e.g. a ball pivot). This ball pivot is slidably guided on the rotation axis of the cylinder block by a centering piston and provides exact radial positioning of sliding plate whatever the swash plate swivelling angle position.

The advantage of such an arrangement of the axial piston machine by the present invention is an improved kinematics solution suitable for all types of applications.

Thanks to this kinematical layout, the radial forces between the piston and the cylinder are lower with comparison to current solutions. Consequently bushings are not required in the cylinder block even for high working pressure. Pistons and piston rods can be lighter. Thus proposed kinematics provides more compact and lighter product, manufacturing costs are cut, efficiency of energy transmission is increased, and noise, vibration and wear are drastically reduced.

This kinematics with reduced transmitted forces is also more favorable for the design of a displacement control mechanism and its associated properties.

BRIEF DESCRIPTION OF THE DRAWINGS

FIG. 5 is a longitudinal cross-section of a second alternative embodiment of an axial piston machine improved by the present invention.

FIGS. 7A and 7B are enlarged fragmentary views of the end of the piston rod shown in FIG. 2 where the first driving rotational surface is created by a generating line, which comprises a straight line and an arc.

DESCRIPTION OF THE PREFERRED EMBODIMENTS

Figure 1:
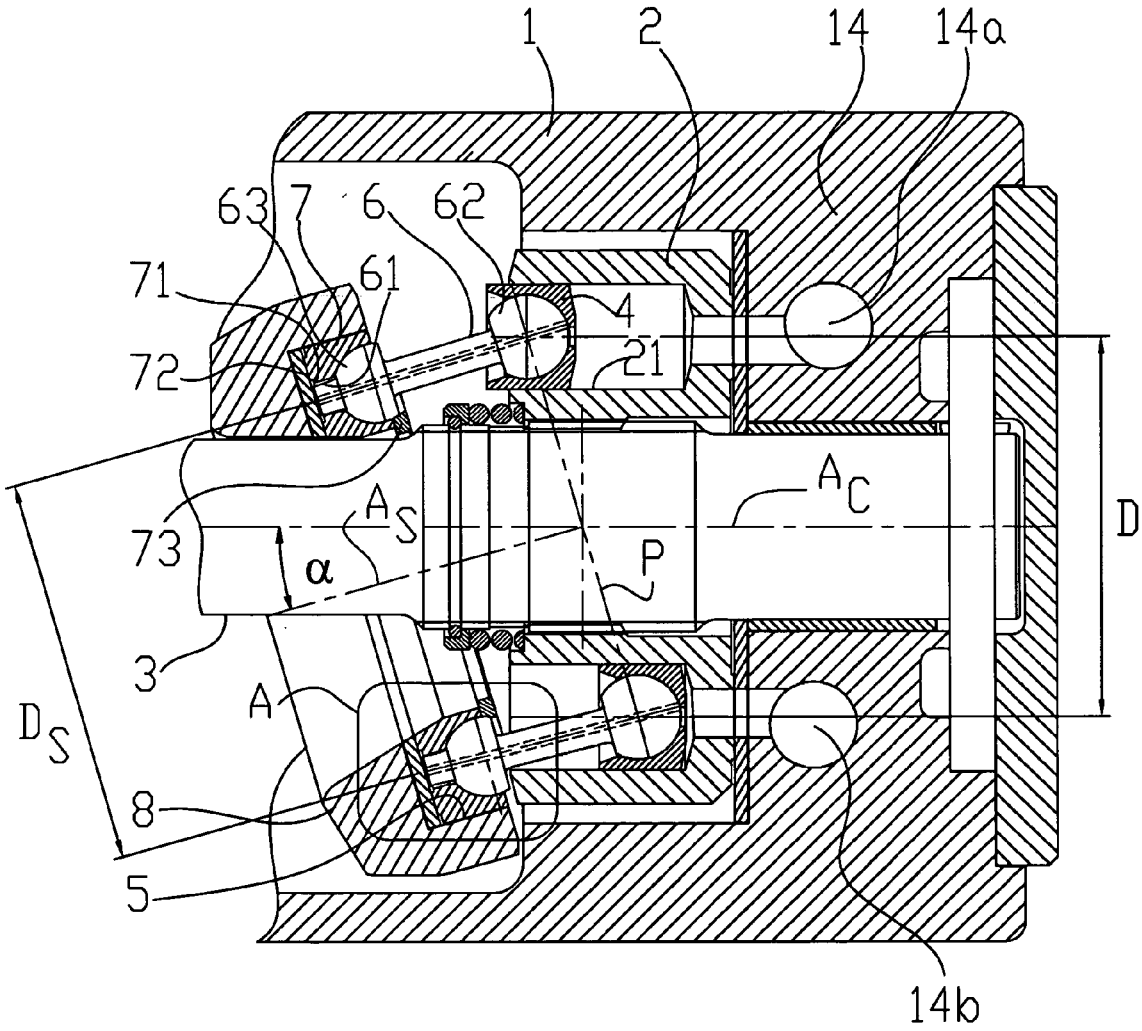
FIG. 1 is a longitudinal cross-section of a part of an axial piston machine improved by the present invention.
Figure 2:
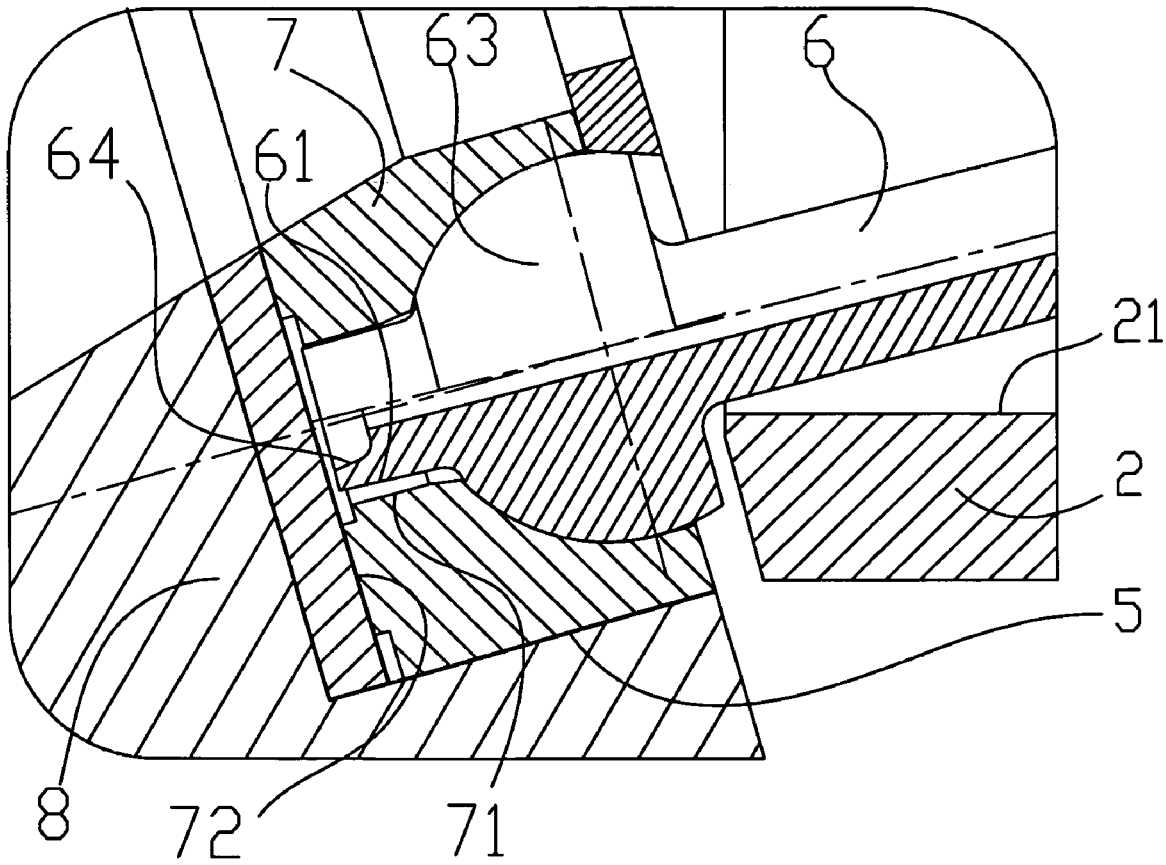
FIG. 2 is detail A from FIG. 1.

Referring to FIGS. 1 and 2:

Inside of a case (1) is rotationally supported a shaft (3), which has splines engaging drive splines of a cylinder block (2) comprising a plurality of cylinders (21), in which reciprocate pistons (4). Each piston (4) is pivotally connected to a piston rod (6) by a first spherical joint (62) and each piston rod (6) is connected with a sliding plate (7) by a second spherical joint (63) embedded in the sliding plate, and each piston rod (6) is maintained in the sliding plate (7) by a retaining ring (73) fixed to the sliding plate (7). On the end of each piston rod (6) is created a first driving rotational surface (61), which is close to an axial bearing (72) of the sliding plate (7). In the body of the sliding plate (7) and for each piston rod (6), is created a second driving rotational surface (71), which is adjacent to the first driving rotational surface (61) linked to the piston rod.

The sliding plate (7) is radially received and supported in a swash plate (8) by a radial sliding bearing (5).

The cylinder block (2) rotates together with the shaft (3) in the case (1). The pistons (4) connected by the piston rods (6) with the sliding plate (7) which rotates on the swash plate (8), reciprocate in the cylinders (21), which are placed at uniform angular pitches and at a constant distance from an axis of rotation ($A_C$) of the cylinder block (2). This reciprocating movement of the pistons (4) causes receiving and discharging of the working fluid between the cylinders (21) and two ports (14*a*, 14*b*) located in a portion (14) of the case, for example a cover of the case. The value of displacement of the cylinders, that determines the cylinder capacity of the machine, is due to the angle of inclination ($A_C$) of the swash plate (8) with respect to the axis of rotation ($A_C$) of the cylinder block. The swash plate (8) is either fixed in the case for a fixed displacement machine or mounted so as to swivel in the case to change this angle of inclination while being pivoted by usual means such as bearings (not shown) in the case (1) for a variable displacement machine.

Each first driving rotational surface (61) synchronizes the sliding plate (7) with the cylinder block (2) thanks to a periodic contact with its adjacent second driving rotational surface (71).

Each pair of these driving rotational surfaces engages twice during one revolution of the shaft with a theoretical engagement angle $$\varphi_1[\circ] = \frac{360}{2 \times z}$$

(z is the number of pistons of the axial piston machine).

Between the first driving rotational surface (61) and the second driving rotational surface (71) of the pair is an optimised radial clearance, which takes into account nominal dimensions, and production tolerances of the rotational parts of the axial piston machine. Furthermore, this radial clearance has to take into account the deformations, which are caused by forces acting on every individual parts of the mechanism that may have an influence on their relative position and associated clearance.

The position of each piston rod (6) with respect to the sliding plate (7) is changing periodically as a function of the angular position of the shaft (3).

Figure 8:
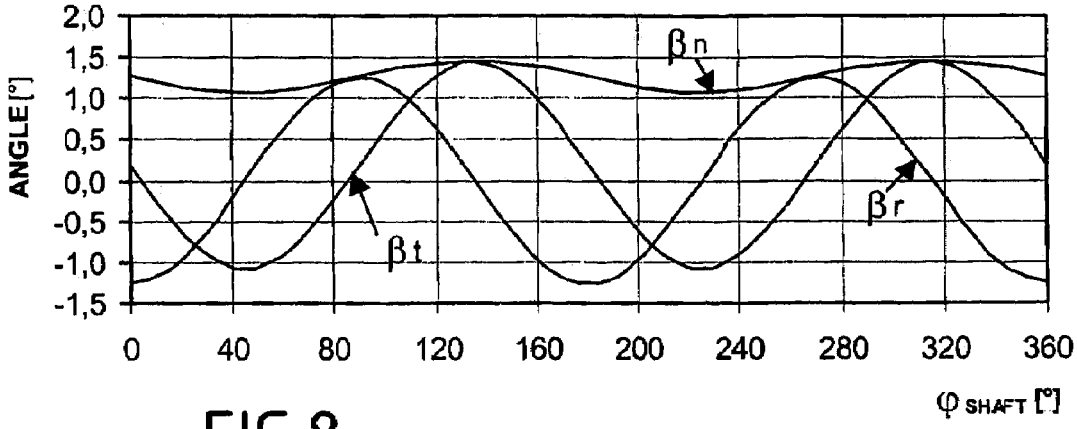
FIG. 8 and FIG. 9 are characteristics, which determine a position of an axis of a piston rod as a function of an angular position of a shaft of an axial piston machine equipped with nine pistons and improved by the present invention. These characteristics are determined for a maximum displacement.
Figure 9:
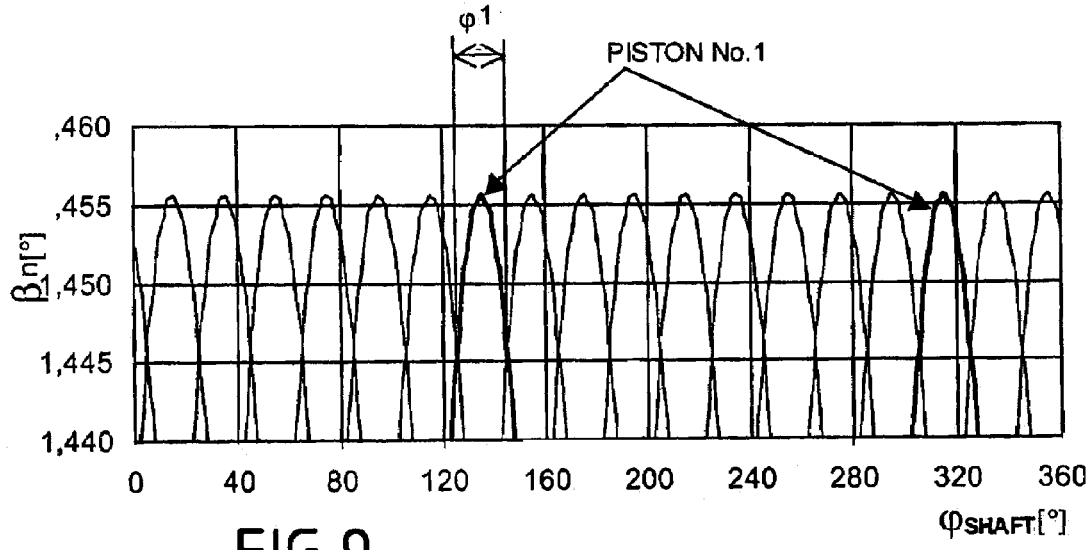
Figure 11:
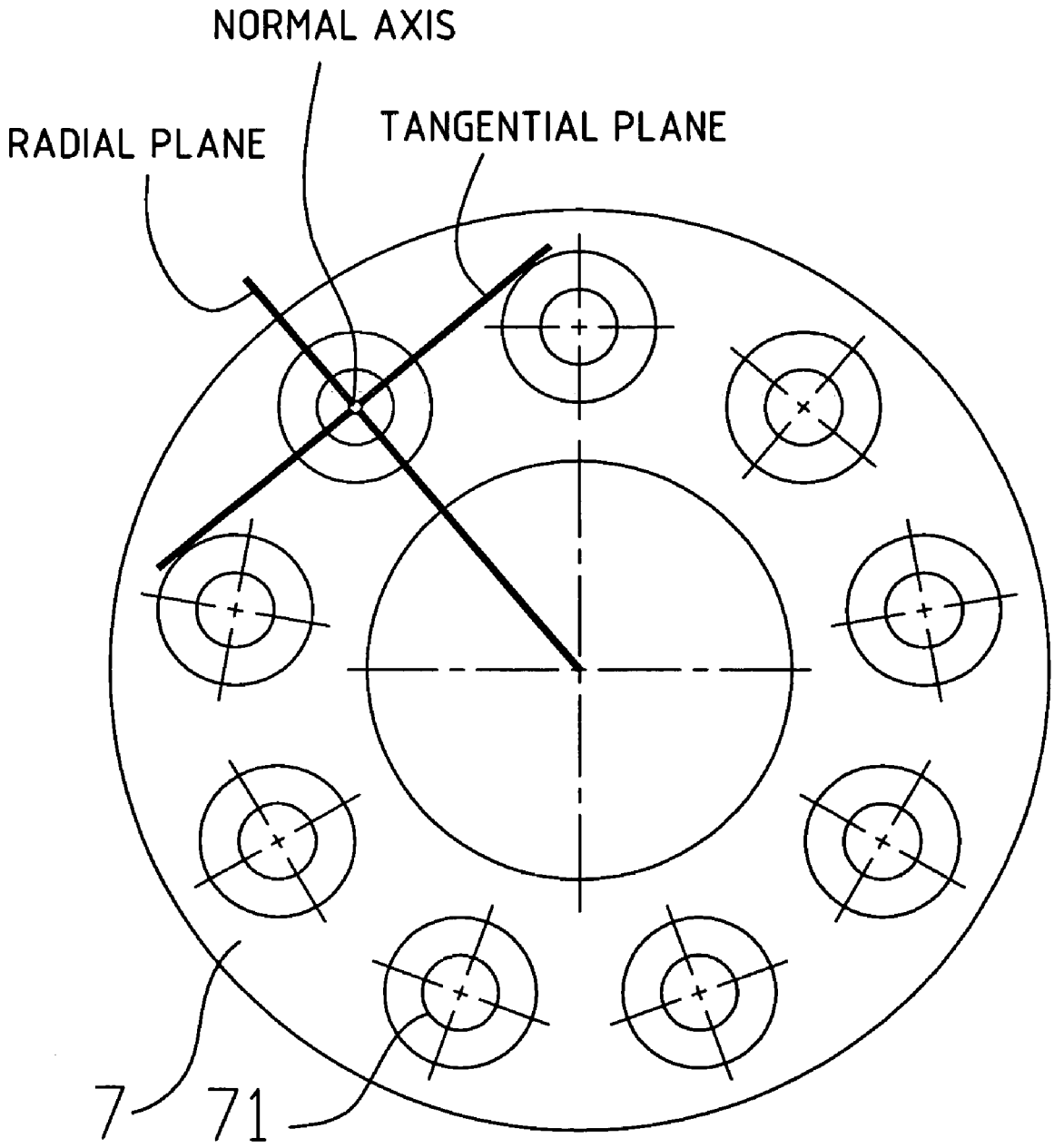
FIG. 11 is a view of the sliding plate showing its face that is perpendicular to its axis of symmetry and that faces the cylinder block, in order to define the orientations of a normal axis, of a tangential plane and of a radial plane.

On FIG. 11 the intersection of radial and tangential planes defines a normal axis for a piston rod. The angle of the axis of the piston rod with this normal axis represents the angle ($\beta_n$), the variations of which during a 360° revolution of the cylinder block are illustrated on FIG. 8 and FIG. 9. This angle ($\beta_n$) can be projected on tangential and radial planes in respectively ($\beta_t$) and ($\beta_r$) that respectively constitute the tangential and the radial components of ($\beta_n$). As it can be seen on FIG. 9, a mutual engagement of the first driving rotational surface (61) and the second driving rotational surface (71) causes only a slight variation of the angle ($\beta_n$), which is favorable for a driving without irregularity of rotational movement, especially for mechanism with high elasticity.

Component ($\beta_t$) influences the magnitude of the forces involved in synchronization between sliding plate and cylinder block. Component ($\beta_r$) influences the magnitude of radial force between the sliding plate (7) and the swash plate (8). Both ($\beta_t$) and ($\beta_r$) angles variations over a 360° revolution of the cylinder block, are illustrated on FIG. 8, where the rotation of the cylinder block is represented by angle ($\phi_{shaft}$).

During a revolution of the cylinder block, the centers of the first spherical joints move on the surface of a geometrical revolution cylinder having a diameter (D) (piston rod pitch diameter of the cylinder block) and of which the geometrical axis is the cylinder block axis ($A_C$). The centers of the second spherical joints move on a circle having a diameter ($D_s$) (piston rod pitch diameter of the sliding plate), contained in a plane perpendicular to the sliding plate axis ($A_s$) and centered on this axis which is inclined by angle $\alpha$ with respect to the cylinder block axis. Considered in a plane (P) (see FIG. 1) perpendicular to the sliding plate axis and in which this axis intersects with the cylinder block axis, this circle remains a circle having a diameter ($D_s$) whereas the section of the said geometrical cylinder with plane (P) is an ellipse having its respective major and minor axes respectively equal to D/cos $\alpha$ and to D.

The synchronisation efforts are minimized when this circle and this ellipse have four points of intersection evenly distributed, which condition is fulfilled when the difference between the major axis of the ellipse and the diameter of the circle is equal to the difference between the diameter of the circle and the minor axis of the ellipse.

$$D/\cos\alpha - D_s = D_s - D,$$

which gives $$\frac{D_s}{D} = \frac{1}{2}\left(1 + \frac{1}{\cos\alpha}\right)$$

Consequently the operation of the machine is optimized when the maximal values of ($\beta_n$), and therefore of its components ($\beta_t$) and ($\beta_r$), are as small as possible.

Consequently, considering that the synchronization efforts have to be kept as low as possible when the swash plate inclination is maximal, that is for the maximum value $\alpha_{max}$ for angle ($\alpha$), the above considerations lead to the formula $$\frac{D_s}{D} = \frac{1}{2}\left(1 + \frac{1}{\cos\alpha_{max}}\right)$$

Figure 10:
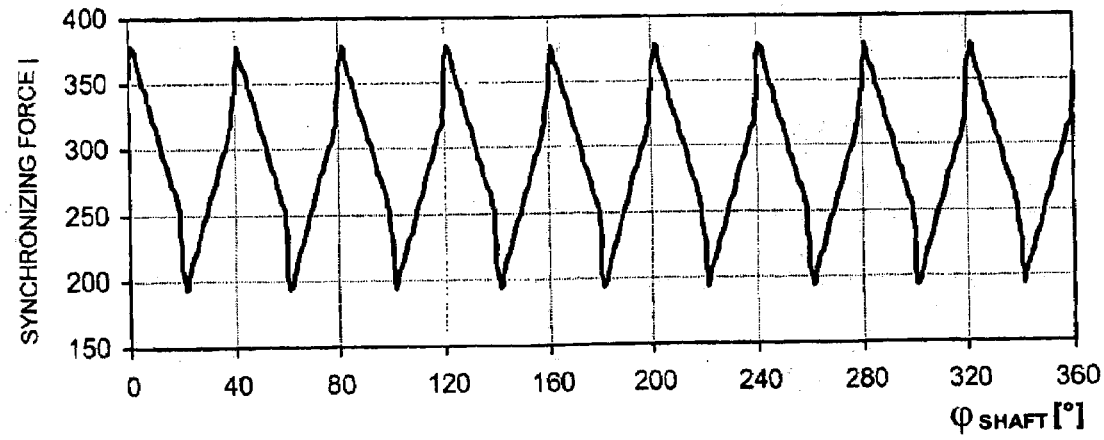
FIG. 10 is an example of a synchronizing force of the axial piston machine by the present invention as a function of angular position of the cylinder block. This characteristic is determined for an outlet working pressure of 42 MPa.

Consequently forces for the synchronization between the sliding plate (7) and the cylinder block (2), as a function of an angular position of the shaft (3), are illustrated on FIG. 10 for a machine comprising nine pistons. All these characteristics are determined with a maximum working pressure, with a maximum value of an angle ($\alpha$) and with a clearance between the first driving rotational surface (61) and the second driving rotational surface (71) in accordance with expected production tolerances of parts, which have an influence on the function of synchronization.

Synchronization forces react discontinuously and periodically in the center of the first spherical joint (62) of each piston rod (6). These synchronisation forces also depend on the distortion of the related parts and the clearance in the mechanism.

Radial position of the sliding plate (7) must be centered with the pump shaft axis when the swash plate angle is equal to zero. A deviation from this position generates an increase of a value of radial force. This radial position is provided for a design of the axial piston machine with throughout going shaft by an arrangement of the sliding plate (7) in a radial sliding bearing (5), which is created in the swash plate (8).

To decrease an edge influence of contact forces between the first driving rotational surface (61) and the second driving rotational surface (71), it is advantageous to modify one of generating lines of these surfaces in segment (61*a*) either by an arc with radius (R) (FIG. 7*a*), or by a curve with continuously variable curvature or by any appropriated curve (FIG. 7*b*), which is continuously connected on a straight line of the generating line in segment (61*b*) as seen on FIG. 7*a* and FIG. 7*b*. A similar influence is possible to reach if in a part of a piston rod (6), which is bounded by means of the first driving rotational surface (61), is created a rotational recess (64) as seen on FIG. 2.

Figure 3:
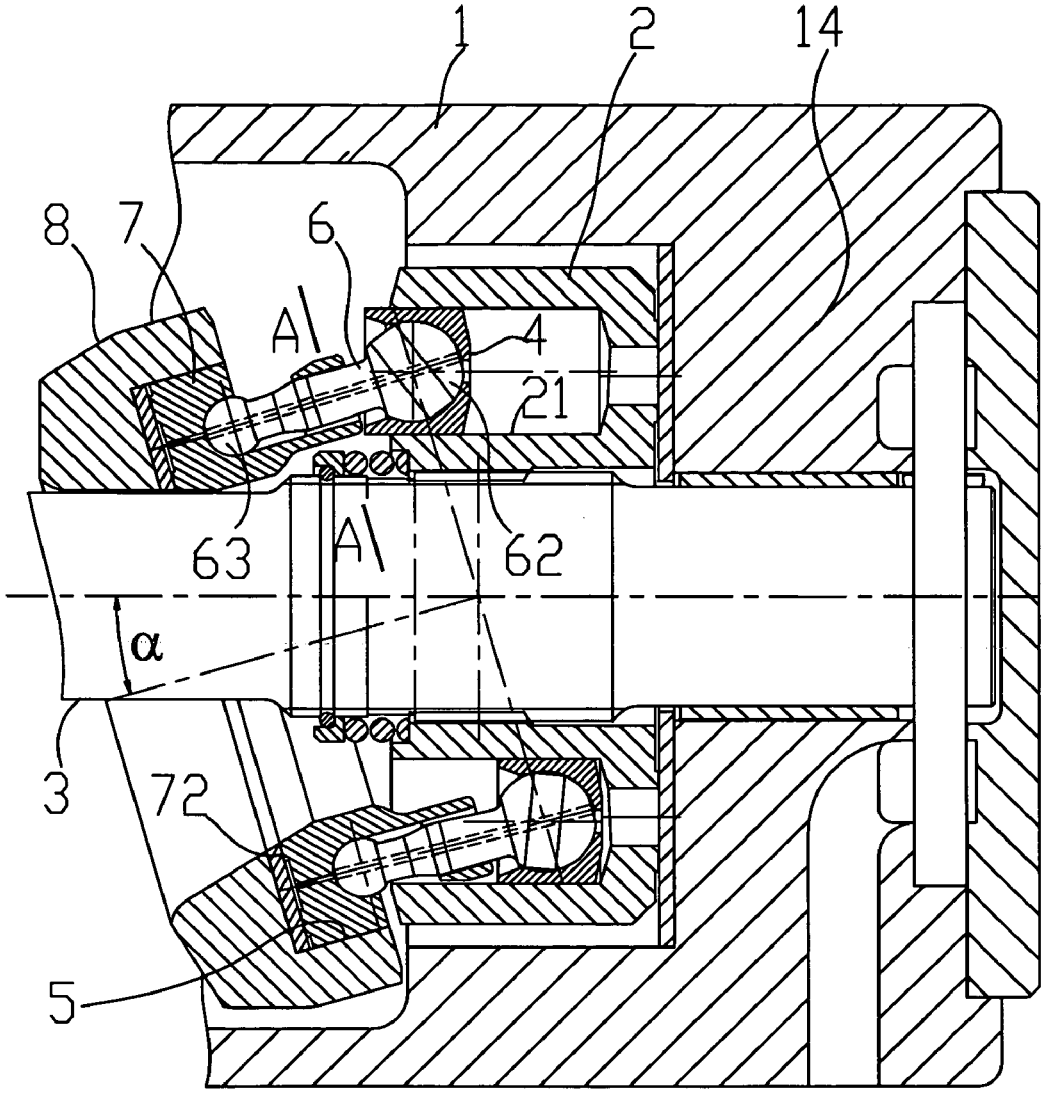
FIG. 3 is a longitudinal cross-section of a first alternative embodiment of an axial piston machine improved by the present invention.
Figure 4:
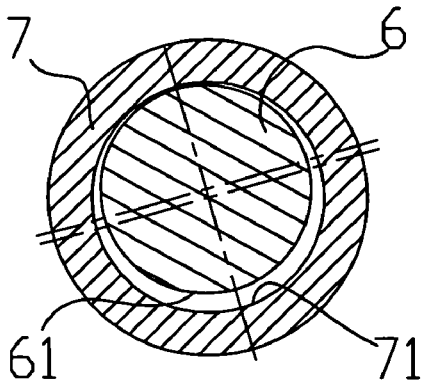
FIG. 4 is a cross-section A—A from FIG. 3.

Referring to FIGS. 3 and 4:

FIG. 3 differs from FIGS. 1 and 2 in that the first driving rotational surface (61) is located between the first spherical joint (62) and the second spherical joint (63). In this embodiment the first driving rotational surface (61) is created on a cylindrical part of the rod of the piston rod (6). The sliding plate (7) comprises an axial extension towards the cylinder block with a substantially radial surface facing the cylinder block. Axial bores are created in this radial surface to receive the piston rods. The internal surface of each axial bore constitutes a second driving rotational surface (71).

Edge influence of contact forces between the first driving rotational surface (61) and the second driving rotational surface (71) is possibly enhanced the same way as described for figure (1) and (2).

Referring to FIG. 5:

This figure differs from FIGS. 1 and 2 in that the first driving rotational surface (61) is created on an inner surface of the piston rod (6). In this case the second driving rotational surface (71) is on a pin (9), which is radially supported in the sliding plate (7). Preferably, the pin (9) is fitted inside the piston rod and axially locked therein by a formed protrusion (91) which allows the swivelling of the piston rod. The first and second driving rotational surfaces are located beyond said formed protrusion, towards the cylinder block and, preferably, in the vicinity of the first spherical joint.

Figure 6:
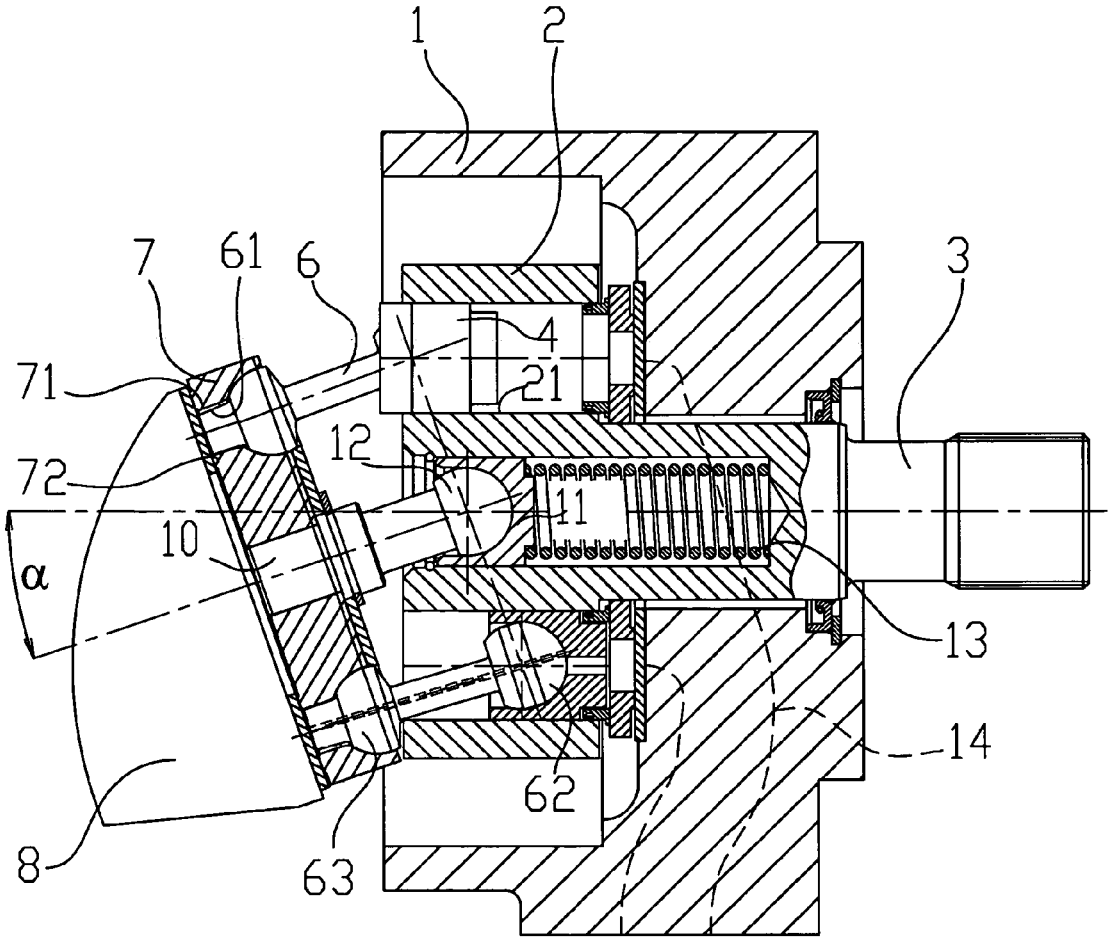
FIG. 6 is a longitudinal cross-section of a part of an axial piston machine with an arrangement from FIG. 1 and with an alternative embodiment of a radial guiding of a sliding plate.

Referring to FIG. 6:

In case of an axial piston machine with a shaft (3) having only one side outlet, the sliding plate (7) is radially led by a centering pivot (10), which ends with a ball pivot (12) surrounded by a centering piston (11), which is shiftably embedded in a bore centered on the axis of rotation of the cylinder block (2). In the centered bore of the cylinder block a spring (13) abuts on the centering piston (11). Spring (13) provides a force contact between the axial bearing (72) of the sliding plate (7) and the swash plate (8).

With this layout, if the axis of rotation of the swash plate (8) does not pass through the center of the ball pivot (12), the maximum stroke of the centering piston (11) can be up to 50% of maximum working stroke of piston (4). As an example, if the axis of rotation of the swash plate is perpendicular to the projecting plane of the FIG. 6 and passes at the center of any spherical joint (62) when its associated piston is in a position of nil stroke, then a bottom dead position of the piston (4) is independent on the angle ($\alpha$) of the swash plate (8) and a dead volume in the bottom dead position will be constant. This solution provides precise radial positioning of sliding plate (7) and piston rods (6) for the shown layout. Synchronizing forces are smaller with this solution. This solution is specifically advantageous to decrease losses, which are caused by a compressibility of a working fluid.

As indicated above, the driving rotational surfaces can have closed or open profiles. In the case of an open profile, the opening is located in a region of the second driving rotational surface where, due to the kinematics, there would be no contact between the driving rotational surfaces if they had closed profiles.

The invention claimed is:

1. An axial piston machine comprising a case, a shaft and a cylinder block arranged so as to rotate in the case, the cylinder block having a plurality of cylinders with pistons, adapted to slide in said cylinders and connected to piston rods by means of first spherical joints, the piston rods being connected to a sliding plate by means of second spherical joints, said sliding plate being supported by a swash plate via a bearing, wherein for the connection between a piston rod and the sliding plate, the machine further comprises a first driving rotational surface which is fixedly connected to the piston rod and a corresponding second driving rotational surface which is fixedly connected to the sliding plate, said first and second driving rotational surfaces being distinct from the second spherical joint that connects said piston rod to the sliding plate and each one of said driving rotational surfaces being formed by a rotation of a generating line around an axis, a clearance being left between said first driving rotational surface and said second driving rotational surface and said surfaces being adjacent.

2. An axial piston machine according to claim 1, wherein a first rotational surface connected to a piston rod is formed in one piece with said piston rod.

3. An axial piston machine according to claim 1, wherein a first rotational surface connected to a piston rod is formed on a part secured to the piston rod.

4. An axial piston machine according to claim 1, wherein a second rotational surface connected to the sliding plate is formed in one piece with said sliding plate.

5. An axial piston machine according to claim 1, wherein a second rotational surface connected to the sliding plate is formed on a part secured to the sliding plate.

6. An axial piston machine according to claim 1, wherein the first driving rotational surface connected to a piston rod is formed on an extension of said piston rod beyond the second spherical joint, said extension being introduced in a recess having a wall that forms the corresponding second rotational surface.

7. An axial piston machine according to claim 1, wherein the first driving rotational surface connected to a piston rod is formed on a segment of the piston rod located between centers of the first spherical joint and the second spherical joint.

8. An axial piston machine according to claim 1, wherein the first driving rotational surface connected to a piston rod is formed in an internal space of the piston rod.

9. An axial piston machine according to claim 4, wherein the second driving rotational surface corresponding to the first driving rotational surface connected to a piston rod is formed on a projecting segment of the sliding plate such as a pin, which is close to the axial bearing and an axis of which passes through a center of the second spherical joint that connects this piston rod to the sliding plate.

10. An axial piston machine according to claim 1, wherein the sliding plate is radially guided by a radial sliding bearing of the swash plate.

11. An axial piston machine according to claim 1, wherein the sliding plate is radially supported on a centering pivot which is connected to a centering piston by means of a centering spherical joint, said centering piston being adapted to slide in a bore formed in the cylinder block, coaxially with the axis of rotation of the latter.

12. An axial piston machine according to claim 1, wherein at least one of the first and second driving rotational surfaces is formed by at least a portion of at least one cylindrical surface.

13. An axial piston machine according to claim 12, wherein at least one of the first and second driving rotational surfaces has a generating line which is a straight line.

14. An axial piston machine according to claim 13, wherein least one of the first and second driving rotational surfaces has a generating line comprising a straight segment which is continuously extended on at least one end by a convex curve.

15. An axial piston machine according to claim 14, wherein the curve has a radius of curvature which is constant.

16. An axial piston machine according to claim 14, wherein the convex curve has a variable radius of curvature.

17. An axial piston machine according to claim 1, wherein at least one of the first and second driving rotational surfaces has a generating line which is a continuous convex curve.

18. An axial piston machine according to claim 1, wherein at least one of the first and second driving rotational surfaces has a generating line which is a variable convex curve.

19. An axial piston machine according to claim 1, wherein a rotational recess is formed in a part, an outer surface of which forms one of the first and second driving rotational surfaces.

20. An axial piston machine according to claim 1, wherein a relation between the piston rod pitch diameter (D) of the cylinder block and the piston rod pitch diameter ($D_S$) of the sliding plate is:

$$\frac{D_s}{D} = \frac{1}{2}\left(1 + \frac{1}{\cos\alpha_{\max}}\right)$$

where $\alpha_{max}$ defines a maximum inclination of the swash plate.

* * * * *